US008350618B2

(12) United States Patent
Park

(10) Patent No.: US 8,350,618 B2
(45) Date of Patent: Jan. 8, 2013

(54) VOLTAGE GENERATION CIRCUIT

(75) Inventor: Jae Boum Park, Ichon-shi (KR)

(73) Assignee: SK Hynix Inc., Gyeonggi-do (KR)

( * ) Notice: Subject to any disclaimer, the term of this patent is extended or adjusted under 35 U.S.C. 154(b) by 96 days.

(21) Appl. No.: 12/970,288

(22) Filed: Dec. 16, 2010

(65) Prior Publication Data

US 2011/0291747 A1 Dec. 1, 2011

(30) Foreign Application Priority Data

May 31, 2010 (KR) ..... 10-2010-0051324

(51) Int. Cl.
*G05F 1/10* (2006.01)

(52) U.S. Cl. ..... 327/541

(58) Field of Classification Search ..... 327/538, 327/540, 541, 543
See application file for complete search history.

(56) References Cited

U.S. PATENT DOCUMENTS

| | | | | |
|---|---|---|---|---|
| 5,774,013 | A * | 6/1998 | Groe | 327/543 |
| 5,861,771 | A * | 1/1999 | Matsuda et al. | 327/540 |
| 6,426,671 | B1 * | 7/2002 | Kono | 327/541 |
| 7,208,931 | B2 * | 4/2007 | Aota | 323/315 |
| 7,327,186 | B1 * | 2/2008 | Wadhwa et al. | 327/541 |
| 7,342,819 | B2 | 3/2008 | Liaw et al. | |
| 7,417,493 | B2 * | 8/2008 | Lee | 327/538 |
| 7,808,068 | B2 * | 10/2010 | Hartley | 257/467 |
| 2002/0080675 | A1 | 6/2002 | Feurle | |
| 2004/0207460 | A1 | 10/2004 | Lukes et al. | |
| 2005/0281094 | A1 | 12/2005 | Seo | |

FOREIGN PATENT DOCUMENTS

| | | |
|---|---|---|
| JP | 2003-338550 | 11/2003 |
| JP | 2006-280062 | 10/2006 |
| KR | 10-1998-0018101 | 6/1998 |
| KR | 1020020091769 A | 12/2002 |
| KR | 10-2004-0093862 A | 11/2004 |

* cited by examiner

*Primary Examiner* — Jeffrey Zweizig
(74) *Attorney, Agent, or Firm* — William Park & Associates Ltd.

(57) ABSTRACT

A voltage generation circuit includes: a first and second rectification circuits; and one or more amplification units connected between the first and second rectification circuits and configured to amplify an output of the first rectification circuit and provide the amplified output to the second rectification circuit. The second rectification circuit generates a reference voltage.

12 Claims, 4 Drawing Sheets

FIG..3

VOLTAGE GENERATION CIRCUIT

CROSS-REFERENCES TO RELATED APPLICATION

The present application claims priority under 35 U.S.C. §119(a) to Korean Patent Application No. 10-2010-0051324, filed on May 31, 2010, in the Korean Intellectual Property Office, which is incorporated herein by reference in its entirety as if set forth in full.

BACKGROUND

1. Technical Field

The present invention relates to a semiconductor circuit and, more particularly, to a voltage generation circuit which may be used in a semiconductor apparatus.

2. Related Art

A reference voltage generation circuit in a voltage generation circuit may be implemented in various manners.

FIG. 1 is a diagram illustrating an example of a conventional reference voltage generation circuit. The depicted reference voltage generation circuit 1 is a Widlar-type reference voltage generation circuit, and includes a plurality of transistors M1 to M10 and a plurality of resistors R1 and R2.

The reference voltage generation circuit 1 generates a reference voltage VREF1 by converting a current, generated through a current mirroring operation of the transistors M1 to M6, into a voltage.

A problem with conventional voltage circuits, such as the reference voltage generation circuit 1, is that the reference voltage VREF1 may vary widely depending on a power supply voltage VDDV, which may be due to the variations in characteristics of basic analog circuit components such as the transistors used in the circuits.

SUMMARY

Accordingly, there is a need for an improved voltage generation circuit that may obviate the above-mentioned problem. It should be understood, however, that some aspects of the invention may not necessarily obviate the problem.

In the following description, certain aspects and embodiments will become evident. It should be understood that these aspects and embodiments are merely exemplary, and the invention, in its broadest sense, could be practiced without having one or more features of these aspects and embodiments.

In one aspect of the present invention, a voltage generation circuit includes a first and second rectification circuits; and one or more amplification units connected between the first and second rectification circuits and configured to amplify an output of the first rectification circuit and provide the amplified output to the second rectification circuit. The second rectification circuit generates a reference voltage.

In another aspect of the present invention, a voltage generation circuit includes: a first rectification circuit configured to rectify a power supply voltage and generate a first voltage; an amplification unit configured to amplify the first voltage and generate a second voltage; a second rectification circuit configured to rectify the second voltage and generate a reference current; and a current/voltage conversion unit configured to generate a reference voltage by converting the reference current to a voltage.

In another aspect of the present invention, a semiconductor apparatus includes a voltage generation circuit. The voltage generation circuit in turn includes: a first rectifier; an amplifier, connected to the first rectifier, that receives a first voltage to generate a second voltage; a second rectifier, connected to the amplifier, that receives the second voltage to generate a reference current; and a converter, connected to the second rectifier, that receives the reference current to generate an output reference voltage.

BRIEF DESCRIPTION OF THE DRAWINGS

The accompanying drawings, which are incorporated in and constitute a part of this specification, explain various embodiments consistent with the invention and, together with the description, serve to explain the principles of the invention.

DETAILED DESCRIPTION

Figure 1:
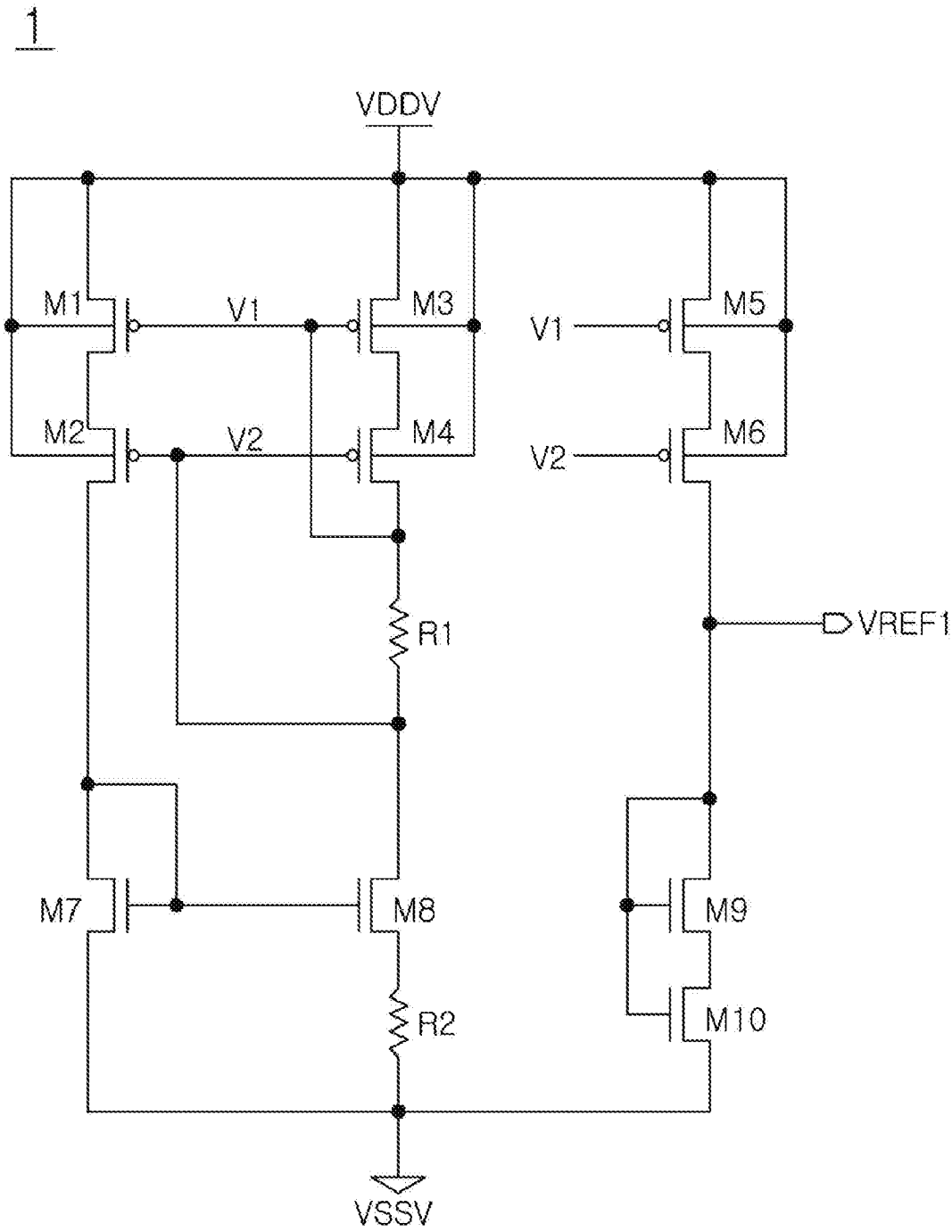
FIG.1 (PRIOR ART)
FIG. 1 is a circuit diagram of a Widlar-type reference voltage generation circuit.

Reference will now be made in detail to the exemplary embodiments consistent with the present disclosure, examples of which are illustrated in the accompanying drawings. Wherever possible, the same reference characters will be used throughout the drawings to refer to the same or like parts.

In one aspect of the present invention, a circuit block for performing a rectifying operation is configured in a plurality of stages, and a voltage depending on a previous rectifying operation is amplified at a predetermined ratio and then rectified again. Therefore, a variation in a reference voltage depending on a power supply voltage may be reduced exponentially.

Figure 2:
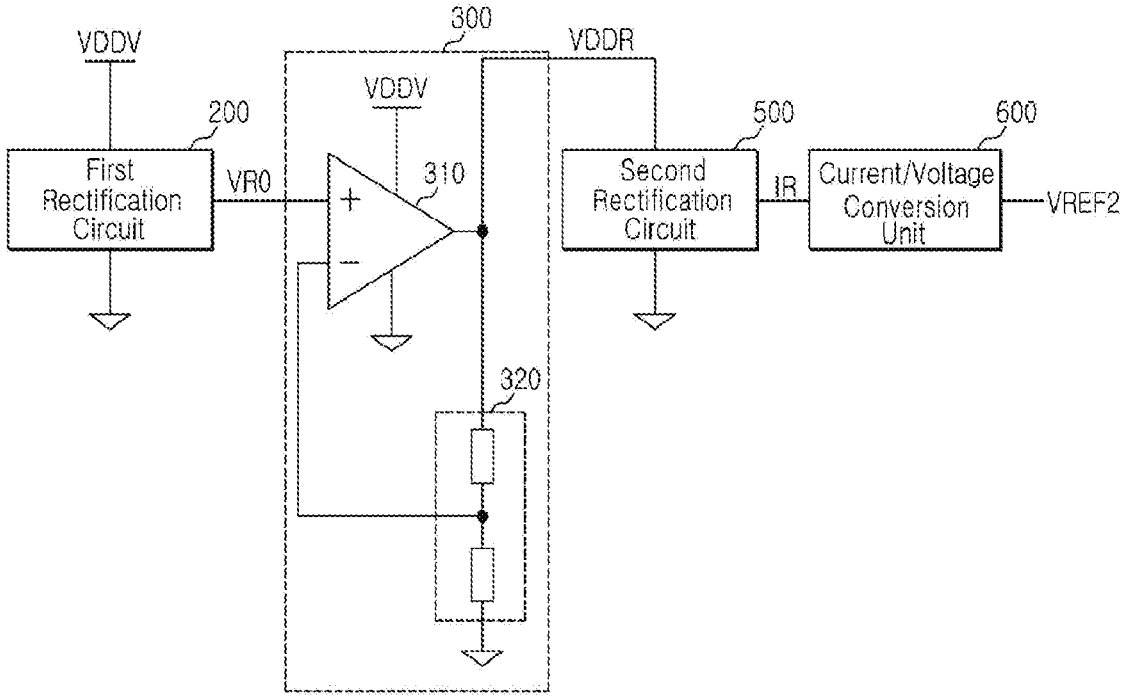
FIG. 2 is a block diagram of a voltage generation circuit according to one exemplary embodiment of the present invention.

FIG. 2 is an illustration of an exemplary voltage generation circuit according to one embodiment of the present invention, in which a circuit block for performing a rectifying operation is configured in two stages.

Referring to FIG. 2, the voltage generation circuit 100 includes a first and second rectification circuits, 200 and 500, an amplification unit 300, and a current/voltage conversion unit 600.

The first rectification circuit 200 is configured to rectify a power supply voltage VDDV and generate a first voltage VR0.

The amplification unit 300 is configured to amplify the first voltage VR0 and generate a second voltage VDDR.

The amplification unit 300 may include a differential amplifier 310 and a voltage divider 320.

The amplification unit 300 uses the voltage divider 320 to amplify the first voltage VR0 at a division ratio of the voltage divider 320, thereby generating the second voltage VDDR.

The second rectification circuit 500 is configured to rectify the second voltage VDDR and generate a reference current IR.

The current/voltage conversion unit 600 is configured to convert the reference current IR into a voltage and generate a reference voltage VREF2.

Figure 3:
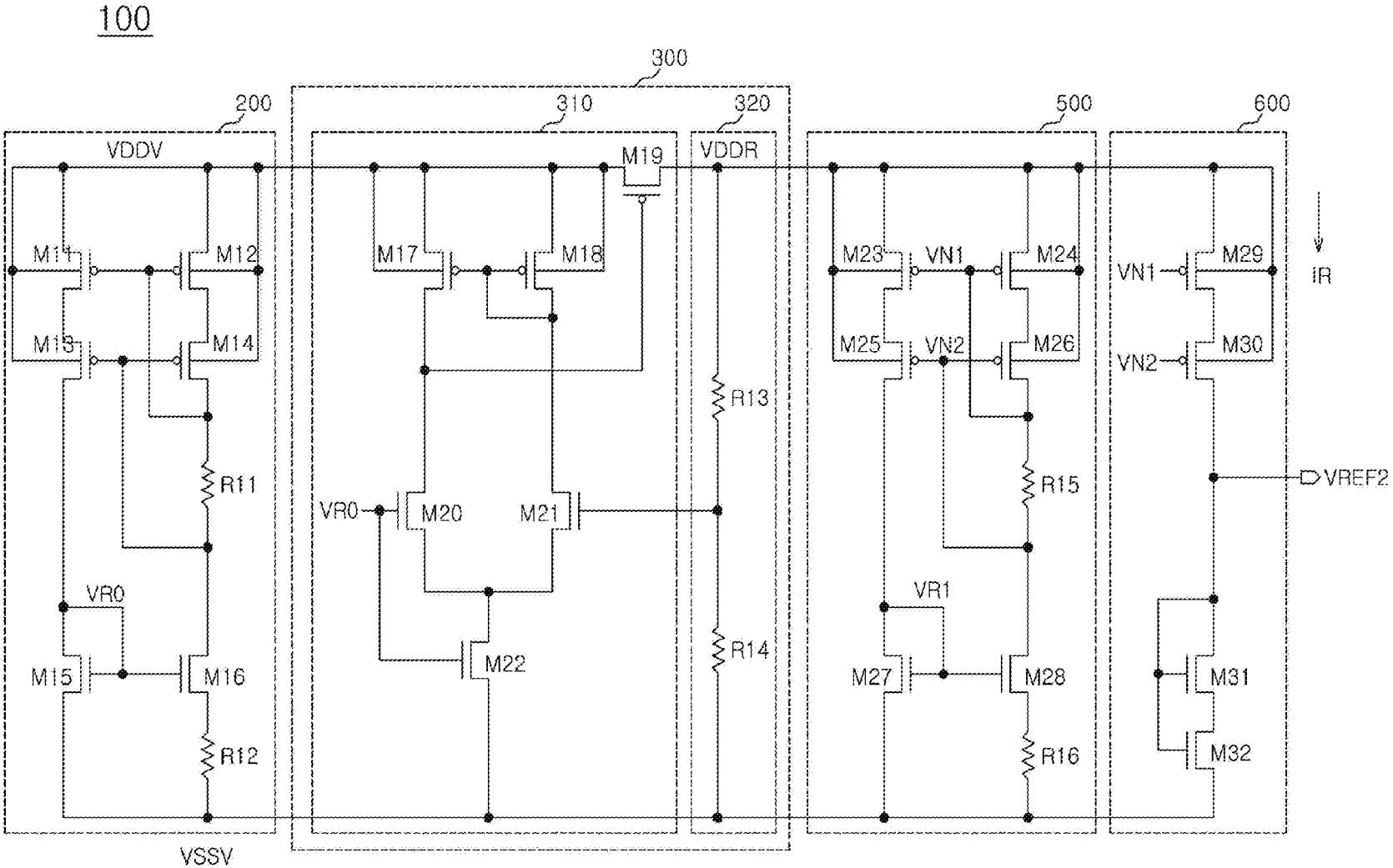
FIG. 3 is a circuit diagram of the voltage generation circuit according to one exemplary embodiment of the present invention.

FIG. 3 is a circuit diagram of the voltage generation circuit according to one exemplary embodiment of the present invention. Referring to FIG. 3, the first rectification circuit 200 includes a plurality of transistors M11 to M16 and a plurality of resistors R11 and R12.

The first rectification circuit 200 may be configured by using any of a number of configurations of a reference voltage generation circuit as is well known in the art. FIG. 3 illustrates an exemplary implementation according to the Widlar-type reference voltage generation circuit.

The differential amplifier 310 may include a plurality of transistors M17 to M22.

The differential amplifier 310 is configured to receive the second voltage VDDR negatively fed back from the voltage divider 320.

The voltage divider 320 may include a plurality of resistors R13 and R14.

The second rectification circuit 500 may include a plurality of transistors M23 to M28 and a plurality of resistors R15 and R16.

The second rectification circuit 500 may be configured in the same manner as the first rectification circuit 200. Also, each of the components in the second rectification circuit 500 has a corresponding component in the first rectification circuit 200. Furthermore, each component in the second rectification circuit 500 may have the same circuit characteristics as the corresponding component in the first rectification circuit 200.

The current/voltage conversion unit 600 includes a plurality of diodes composed of a plurality of transistors M29 to M32.

Referring to FIG. 3, the operation of the exemplary voltage generation circuit 100 according to this embodiment will be described as follows.

The power supply voltage VDDV is rectified through the first rectification circuit 200 to generate the first voltage VR0.

The first voltage VR0 is amplified at the division ratio of the voltage divider 320, and negatively fed back to the differential amplifier 310 to generate the second voltage VDDR. In this embodiment which uses the two resistors R13 and R14, the level of the second voltage VDDR corresponds to VR0*(1+R13/R14).

The second voltage VDDR generated in such a manner may be rectified through the second rectification circuit 500. Thus, the level of the third voltage VR1 is equalized to the first voltage VR0.

A reference current IR corresponding to the same amount as the amount of current flowing in the second rectification circuit 500 passes through the current/voltage conversion unit 600 by a current mirroring operation, depending on the third voltage VR1.

The reference current IR is converted into a reference voltage VREF2 by the plurality of diodes of the current/voltage conversion unit 600, which are composed of the transistors M29 to M32.

As the voltage generation circuit according to this embodiment includes the two-stage rectification circuits, circuits 200 and 500, the rectification characteristic may improve exponentially as expressed blow:

$$\{(\Delta VREF2)\hat{}2/(\Delta VDDV)\hat{}2\}*(1+R13/R14)$$

Figure 4:
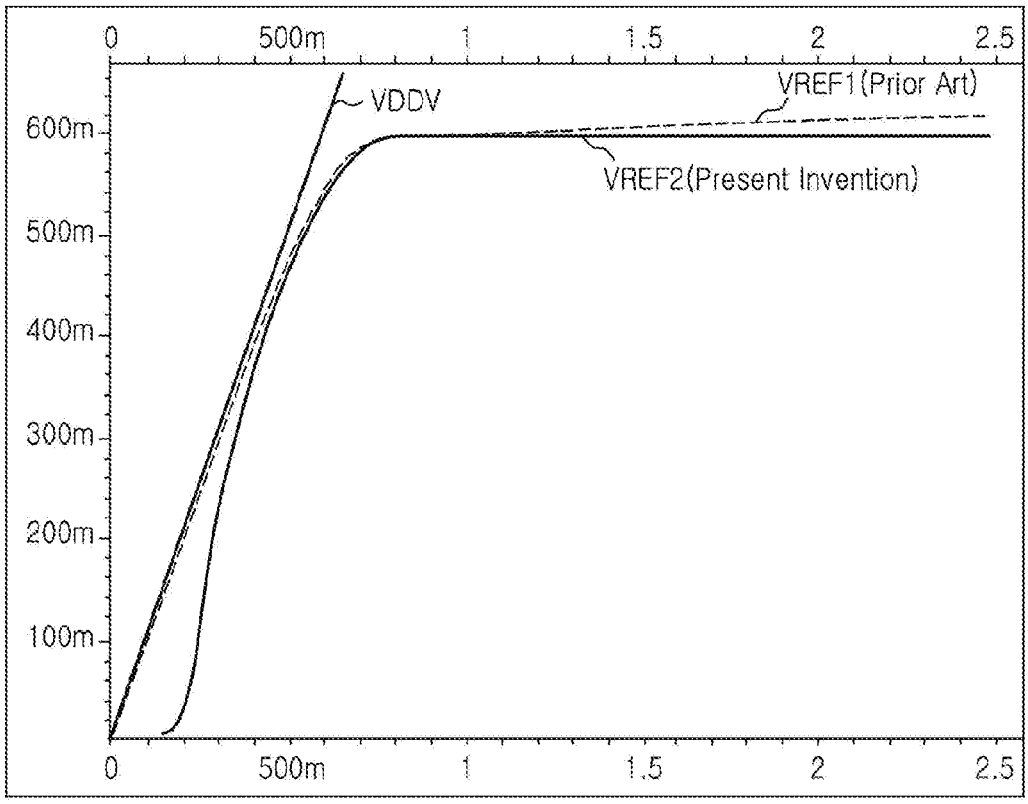
FIG. 4 is a simulation waveform diagram comparing a reference voltage of the voltage generation circuit according to one embodiment of the present invention with a reference voltage of a conventional voltage generation circuit.

FIG. 4 depicts a simulation waveform diagram showing the reference voltage of the voltage generation circuit according to this embodiment and the reference voltage of the conventional voltage generation circuit. Referring to FIG. 4, as the power supply voltage VDDV is varied by 1V in the conventional voltage generation circuit, the reference voltage VREF1 is varied by 11.46 mV. However, as the power supply voltage VDDV is varied by 1V in the voltage generation circuit according to this embodiment, the reference voltage VREF2 is varied by 0.22 mV.

That is, the voltage generation circuit according to this embodiment may reduce the variation in the reference voltage with respect to the same variation in the power supply voltage to about 1/52 of that in the conventional voltage generation circuit.

Therefore, according to this embodiment, it is possible to expect a 52 times larger performance improvement over the conventional voltage generation circuit 100.

According to this embodiment, since the rectification characteristic may be improved by the amplification operations of at least two or more rectification circuits, it is possible to generate the is reference voltage of which the variation depending on the power supply voltage is reduced in comparison with the conventional voltage generation circuit.

While certain aspects of the present invention have been described above, it will be understood to those skilled in the art that the aspects described are by way of example only. Accordingly, the voltage generation circuit described herein should not be limited based on the described aspects. Rather, the voltage generation circuit described herein should only be limited in light of the claims that follow when taken in conjunction with the above description and accompanying drawings.

What is claimed is:

1. A voltage generation circuit comprising:

a first and second rectification circuits; and one or more amplification units connected between the first and second rectification circuits and configured to amplify an output of the first rectification circuit and provide the amplified output to the second rectification circuit as a source voltage of the second rectification circuit;

wherein the second rectification circuit generates a reference voltage.

2. The voltage generation circuit according to claim 1, wherein the amplification unit is configured to amplify and provide the output of the first rectification circuit to the second rectification circuit, and the output of the amplification unit is negatively fed back to the amplification unit.

3. A semiconductor apparatus including a voltage generation circuit, the voltage generation circuit comprising:

a first rectifier configured to rectify a power supply voltage and generate a first voltage;

an amplifier configured to amplify the first voltage and generate a second voltage;

a second rectifier configured to receive the second voltage as a source voltage to generate a reference current; and a converter, connected to the second rectifier, that receives the reference current to generate an output reference voltage.

4. The semiconductor apparatus according to claim 3, wherein the first rectifier is a Widlar-type reference voltage generation circuit.

5. The semiconductor apparatus according to claim 4, wherein the second rectifier is a Widlar-type reference voltage generation circuit.

6. The semiconductor apparatus according to claim 3, wherein an output of the amplifier is negatively fed back to an input of the amplifier.

7. The semiconductor apparatus according to claim 3, wherein the amplifier comprises a differential amplifier and a voltage divider.

8. The semiconductor apparatus according to claim 7, wherein the voltage divider comprises a plurality of resistors.

9. The semiconductor apparatus according to claim 8, wherein the plurality of resistors comprises a first resistor with a first resistance value R1 and a second resistor with a second resistance value R2.

10. The semiconductor apparatus according to claim 9, wherein the second voltage corresponds to the first voltage multiplied by (1+R1/R2).

11. The semiconductor apparatus according to claim 5, wherein each component in the first rectifier has a corresponding component in the second rectifier.

12. The semiconductor apparatus according to claim 11, wherein each component in the second rectifier has a same circuit characteristics as the corresponding component in the first rectifier.

* * * * *